United States Patent [19]

Molins et al.

[11] 4,280,611

[45] Jul. 28, 1981

[54] CIGARETTE CONVEYOR SYSTEMS

[75] Inventors: Desmond W. Molins; Dennis Hinchcliffe; Frank Heybourn; Raymond G. Coyte, all of Deptford, England

[73] Assignee: Molins Limited, London, England

[21] Appl. No.: 865,212

[22] Filed: Dec. 28, 1977

Related U.S. Application Data

[63] Continuation-in-part of Ser. No. 633,714, Nov. 20, 1975, abandoned.

[30] Foreign Application Priority Data

Nov. 27, 1974 [GB] United Kingdom ..... 51321/74

[51] Int. Cl.[3] ..... B65G 1/00

[52] U.S. Cl. ..... 198/347; 198/572; 198/575; 198/577; 198/580

[58] Field of Search ..... 198/347, 524, 571–573, 198/575, 577, 580; 131/21 R, 21 B, 25, 21 A

[56] References Cited

U.S. PATENT DOCUMENTS

| | | | |
|---|---|---|---|
| 3,665,933 | 5/1972 | Molins et al. | 131/25 |
| 3,726,383 | 4/1973 | Bornfleth et al. | 131/25 |
| 3,789,744 | 2/1974 | Wahle | 131/21 A |
| 3,794,049 | 2/1974 | Wochnowski | 131/21 A |

FOREIGN PATENT DOCUMENTS

| | | | |
|---|---|---|---|
| 1299175 | 12/1972 | United Kingdom | 198/347 |

*Primary Examiner*—Joseph E. Valenza
*Attorney, Agent, or Firm*—Craig and Antonelli

[57] ABSTRACT

In a system for making and packing cigarettes, cigarette making and packing machines are arranged in units each including a making machine, a packing machine and a reservoir, each unit being slightly mis-matched as to its making and packing outputs so as to have, on average, a surplus or deficit of cigarettes which is fed away or made up by a transfer conveyor linked to an additional packing or making machine which absorbs the surplus or makes up the deficit of all the units as the case may be.

13 Claims, 10 Drawing Figures

CIGARETTE CONVEYOR SYSTEMS

This application is a continuation-in-part of application Ser. No. 633,714, filed Nov. 20, 1975, now abandoned.

This invention is concerned with conveyor systems for delivering cigarettes or similar rod-like articles from a number of making machines to a number of packing machines. Such systems have commonly in the past involved the use of tray filling and tray unloading units; that is to say, all the cigarettes made by the making machines are first handled by a tray-filling unit which delivers the cigarettes into trays, and are then conveyed in the trays to a tray-unloading unit which feeds the cigarettes from the trays and into cigarette packing machines. In contrast with such systems, the present invention is concerned with the direct feeding of cigarettes from making machines to packing machines without the use of trays.

Simple systems for feeding two packing machines from the output two making machines (or one making machine) are shown in FIG. 8 of British Pat. No. 1,299,174, which is referred to in its entirety. Such systems cannot, however, satisfactorily be expanded to deal with a much larger number of making and packing machines. The present invention is concerned with providing a system which can include a large number of machines.

This invention is mainly concerned with the manufacture of cigarettes. However, similar rod-shaped articles can also be handled by systems according to this invention, for example cigarette filter rods. We will for convenience refer in this specification only to cigarettes, and it should be understood that the term "cigarette" in this context is intended to include other similar rod-shaped articles.

According to one aspect of the present invention a cigarette making system includes a number of units each comprising a cigarette making machine, a cigarette packing machine which receives cigarettes directly from the cigarette making machine, and a reservoir which accommodates differences between the rates of cigarette supply and demand, characterised in that the output of the cigarette making machine in each unit is greater than that of the associated packing machine, and that the system includes an additional packing machine which is not directly associated with a making machine, and a transfer conveyor which feeds surplus cigarettes from the cigarette making machines to the additional packing machine.

According to another aspect of this invention, a cigarette making system includes a number of units each comprising a cigarette making machine, a cigarette packing machine which receives cigarettes directly from the cigarette making machine, and a reservoir which accommodates differences between the rates of cigarette supply and demand, characterised in that the output of the cigarette making machine in each unit is less than that of the associated packing machine and that the system includes an additional cigarette making machine which is not directly associated with a packing machine, and a transfer conveyor which delivers cigarettes from the additional making machine into each of the packing machines.

Systems according to this invention are especially useful with making and packing machines which have capacities such that a simple balance is not possible; for example, where the output of each making machine (or of two making machines) is slightly more than the capacity of each packing machine or of, for example, two packing machines. In this last case there is a continuous excess of cigarettes from each unit, and the transfer conveyor may be arranged to deliver the accumulated excesses from all the units to one or more packing machines which are not directly linked to making machines. Alternatively, each unit may have a deficit which is required to be made up by means of an additional making machine.

In another system according to this invention the conveyor linking the various units in effect forms a closed loop or what may be termed a "ring main". That is to say, the conveyor, which would be formed of a number of separate sections extending between successive units, receives any excess from a given unit and passes that excess further downstream so that it can be absorbed by any unit which has a temporarily reduced or non-operative making capacity. The flow of cigarettes around the ring main is preferably in a fixed direction.

In the ring main system each reservoir preferably includes means for indicating the quantity of cigarettes in the reservoir, and there is preferably provision for equalising out the quantity of cigarettes in the various reservoirs. For example, the quantity of each reservoir may be compared continuously with the quantity in the adjacent reservoir downstream along the ring main, and the section of the conveyor extending between those two reservoirs may be arranged to have its speed increased automatically when the first reservoir contains more cigarettes than the second reservoir.

Examples of systems according to this invention are shown in the accompanying drawings. In these drawings.

Figure 1:
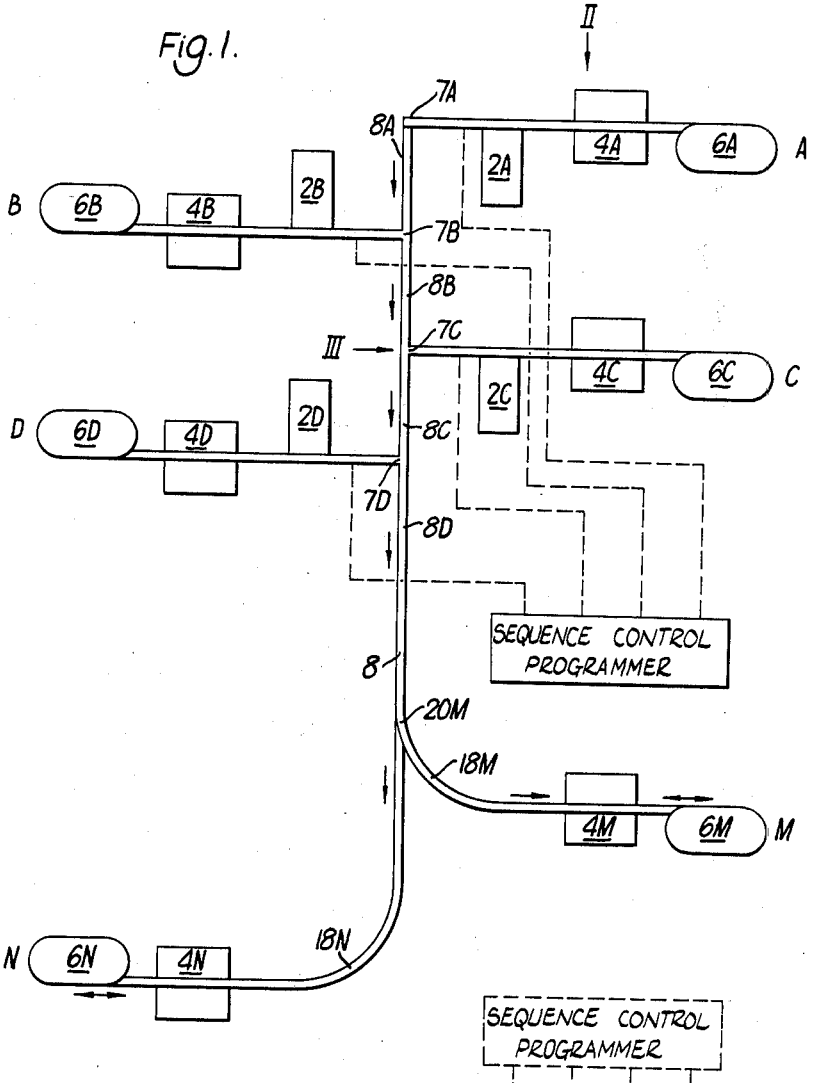
FIG. 1 is a diagrammatic plan view of one system.

The system shown in FIG. 1 includes a number of cigarette making machines 2A, 2B, 2C etc., a number of cigarette packing machines 4A, 4B, 4C etc., and a number of cigarette reservoirs 6A, 6B, 6C etc. Each cigarette making machine is directly linked with a packing machine and with a reservoir to form a unit A, B, C etc., comprising, for example, the components 2A, 4A and 6A. In addition there are a number of packing machines, for example packing machines 4M and 4N shown in FIG. 1, which are not directly linked with a cigarette making machine but have associated reservoirs 6M and 6N respectively. These packing machines receive cigarettes from the making machines 2A, 2B etc. via a transfer conveyor 8.

Figure 2:
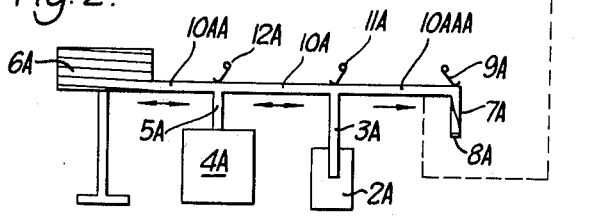
FIG. 2 is a view in the direction of the arrow II in FIG. 1.

As shown in FIG. 2, each cigarette making machine delivers cigarettes in stack formation upwards through an elevator 3A to an overhead conveyor assembly comprising conveyor sections 10A, 10AA, and 10AAA. Section 10A of the conveyor assembly carries a continuous stack of cigarettes to a junction above a chute 5A leading to the packing machine 4A. Section 10AA of the overhead conveyor assembly leads to the reservoir 6A. Surplus cigarettes are fed by conveyor section 10AAA to a short chute 7A which leads downwards to the first section 8A of the transfer conveyor, which is also overhead. The chute 7A is twisted through 90° about its vertical axis in order to bring about the necessary change in the orientation of the cigarettes, which at all times move sideways.

The conveyor section 10AAA may move at a predetermined speed, and a sensor 9A may be included above the chute 7A to provide a degree of control over the speed of the conveyor section 8A. A further sensor 11A controls the speed and direction of the conveyor section 10A, while a sensor 12A controls the speed and direction of the conveyor section 10AA and also of the reservoir. Each reservoir may be substantially as shown in FIGS. 1 and 2 of British Pat. No. 1,299,174, which Figures correspond to FIGS. 1 and 2 of McCombie U.S. Pat. No. 4,030,595. Each elevator, e.g. elevator 5A, may be as described in U.S. Pat. No. 4,120,039, issued Oct. 17, 1978, but may alternatively be in the form shown in FIG. 6 of British Pat. No. 1,299,174. Various forms of sensor device may be used, for example one of those described in the last-mentioned specification.

Figure 3:
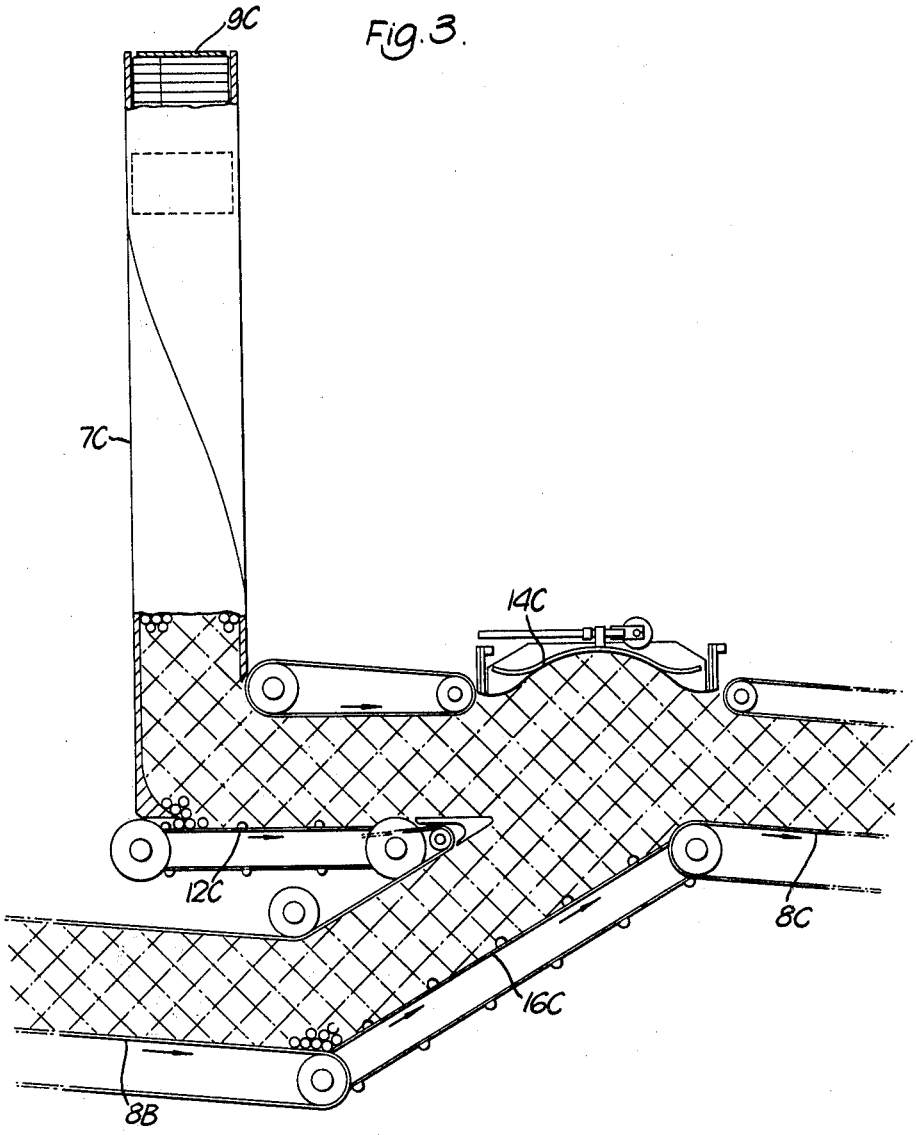
FIG. 3 is an enlarged fragmentary view in the direction of the arrow III in FIG. 1.

At the ends of the overhead conveyor assemblies associated with the units B,C, D etc. there are flow junctions as shown in FIG. 3. That is to say, the chute (e.g. 7C) through which excess cigarettes are delivered extends downwards to a short horizontal conveyor 12C which carries a stack of the cigarettes towards a junction below a sensor 14C. The portion of the transfer conveyor 8B leading towards the junction is arranged to carry a stack of cigarettes, which leads to the junction below the sensor 14C. The two stacks merge in the junction, and the combined stack (assuming both conveyors 12C and 8B are running) is carried from the junction by the portion 8C of the transfer conveyor. It will be noted that the portion 8C is downwardly inclined; the inclination is such that the conveyor portion 8C, at its downstream end, reaches the level of the lower end of the next junction conveyor 16D, i.e. the level of the portion of conveyor 8B shown in FIG. 3. The speed of the transfer conveyor portion 8C may be basically predetermined in any given circumstances, but with slight variations controlled by the sensor 14C.

Each of the packing machines 4M and 4N is supplied with cigarettes from the transfer conveyor 8 via an overhead conveyor 18M or 18N which moves along a curved path. These conveyors may be in the form shown in FIGS. 12 to 17 of British Pat. No. 1,299,174. The conveyor 18N receives cigarettes from the transfer conveyor 8 via a short chute extending downwards from a junction 20M.

Each cigarette making machine can deliver slightly more cigarettes than the associated packing machine can handle. For example, each cigarette making machine may have an output of 4,500 cigarettes per minute, and each packing machine may have a capacity of 3,500 cigarettes per minute. The excess from the cigarette making machines is used to supply the additional packing machines 4M and 4N. This may be achieved, for example, in either of the following ways.

One way is to arrange that all the cigarette making machines continuously supply some cigarettes to the transfer conveyor 8, the total supplied to the transfer conveyor being sufficient for the additional packing machines 4M and 4N. That is to say, an amount which on average equals the difference in the maker and packer capacities (for example 4,500 minus 3,500 c.p.m.) is fed down the corresponding chute 7A, 7B etc. to the transfer conveyor 8. Thus successive sections 8A, 8B, 8C etc. of the transfer conveyor convey increasing quantities of cigarettes.

If one of the packing machines stops for a prolonged period, the system may be arranged to operate as follows. The conveyor speeds are automatically changed so that the output of cigarettes from the making machines associated with the non-operative packing machine is delivered partly to the associated reservoir and partly to the reservoirs 6M and 6N, preferably at a substantially equal rate to all three reservoirs. Ultimately, if the stoppage of the packing machine continues, the associated reservoir and the reservoirs 6M and 6N will become full and the cigarette making machine associated with the non-operative packing machine may be automatically stopped.

On the other hand, if a maker stops, the system may be so arranged that the associated reservoir delivers cigarettes to the associated packer but not to the transfer conveyor. If the stoppage of the maker continues, the associated reservoir eventually becomes empty and the associated packing machine may be stopped automatically.

Another mode of operation of the system is as follows. The transfer conveyor 8 may be supplied by successive making machines on a time-sharing basis under the control of a sequence control programmer, as shown in FIG. 1, controlling the speeds of the respective surplus delivery conveyors 10AAA etc. For example, at any given moment, the transfer conveyor 8 may receive the full output (or a predetermined proportion thereof) from one making machine (or possibly from two making machines), while the associated packing machine (or machines) receives the cigarettes which it requires from the associated reservoir (or reservoirs). It will be understood that the full output of each making machine, e.g. maker 2A, can be selectively delivered to the transfer conveyor by driving the associated surplus delivery conveyor 10AAA at an appropriate predetermined speed.

The sequence of operations and manner of operation may be strictly predetermined so that, for example, the full outputs of makers 2A, 2B, 2C and 2D are delivered successively to the transfer conveyor for equal periods of time in a constantly repeating cycle; for that purpose the programmer may simply comprise a switching device which switches successive surplus delivery conveyors one at a time on to full speed operation. Alternatively, the programmer may automatically change the manner or sequence of operation when occasion demands. For example, if a packing machine stops, the programmer may be programmed to provide that the output of the associated maker (while it is being called upon to supply cigarettes to the transfer conveyor) is fed mainly to the transfer conveyor but partly to its associated reservoir; thus before it ultimately becomes necessary to switch off that making machine, its associated reservoir as well as the reservoirs 6M and 6N are utilised to absorb the surplus cigarettes. On the other hand, if the packing machine linked with a making machine which is not at that moment supplying the transfer conveyor stops (or if its reservoir becomes full), the programmer may be adapted to provide that the supply of cigarettes to the transfer conveyor is taken over for a predetermined period by the making machine associated with the non-operative packing machine.

Conversely, if a making machine stops, the manner of operation of the system may be automatically controlled so that all the cigarettes in the associated reservoir are delivered to the associated packing machine; i.e. none to the transfer conveyor. Thus the cigarette deficit is shared between the associated reservoir and the reservoirs 6M and 6N.

Each packing machine 4A, 4B, 4C etc. may be replaced by two (or more) packing machines. It is also possible to replace each making machine 2A, 2B, 2C etc. with two or more slow-speed making machines.

FIGS. 1 and 2 show a system in which each making machine 2A, 2B etc. has an output slightly greater than that of the associated packing machine. The mis-match between making and packing machines may be reversed; that is to say, instead of needing additional packing machines which are not directly linked with making machines, it may be necessary to include one or more additional making machines which are not directly linked with packing machines but are used simply to supply cigarettes to make up the deficiency of the other making machines. An example of such an arrangement is shown in FIGS. 4 and 5.

Figure 4:
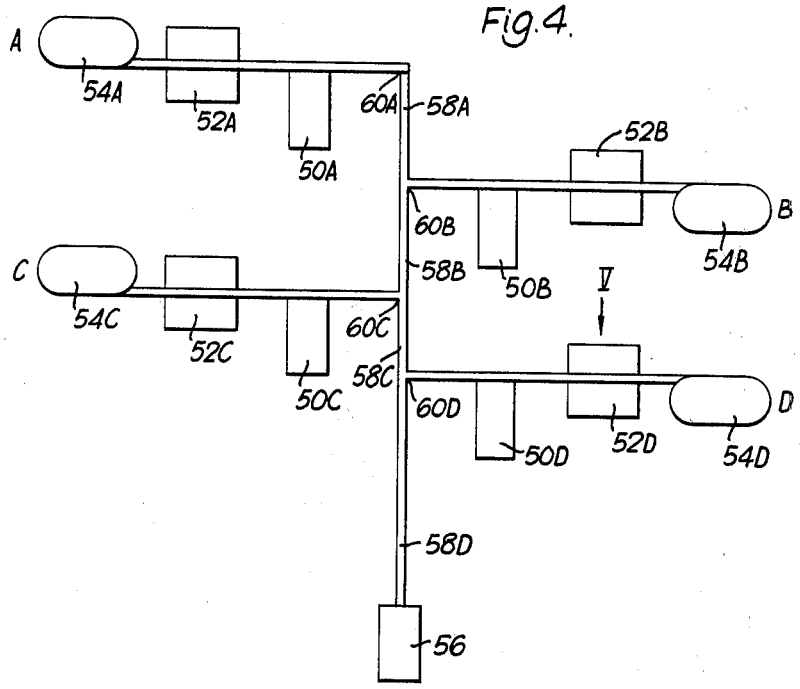
FIG. 4 is a diagrammatic plan view of a different system.
Figure 5:
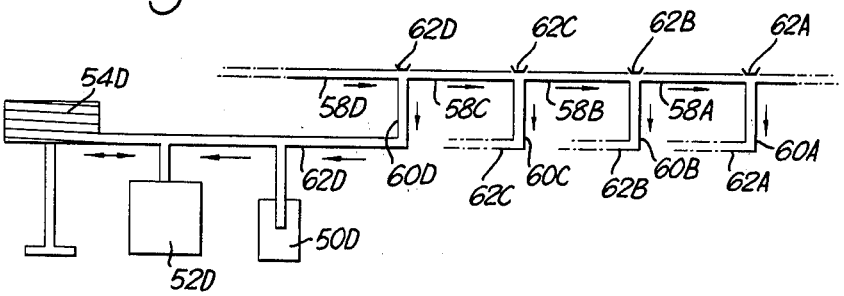
FIG. 5 is a developed elevational view of the system shown in FIG. 4, taken mainly in the direction of the arrow V in FIG. 4.

FIGS. 4 and 5 show a system in which four making machines 50A to D are linked directly with four packing machines 52A to D respectively, each maker-packer combination having an associated reservoir 54A, 54B, 54C or 54D. The system includes also an additional making machine 56 which makes up the deficit of the making machines 50A to D by delivering cigarettes to the four combinations via an overhead transfer conveyor comprising conveyor sections 58A to D.

Each maker/packer/reservoir combination has an overhead conveyor system slightly below the level of the transfer conveyor. Thus each combination can be fed with cigarettes from the transfer conveyor via a chute 60A, 60B, 60C or 60D above which there is a sensor 62A, 62B, 62C or 62D; sensors 62D, 62C, and 62B may control the speeds of transfer conveyor sections 58C, 58B and 58A respectively, and sensor 62A may control the speed at which cigarettes are drawn from the bottom of the chute 60A by combination A.

FIG. 5 shows combination D in side elevation. However, it should be understood that the transfer conveyor 58A to D has been turned through 90° about the chute 60D so that it and other associated parts can be seen in FIG. 5. Also, it should be understood that the chutes 60A, 60C and 60D are in fact twisted through 90° about their axes to enable the overhead conveyor systems of the four combinations A to D to extend transversely to the transfer conveyor, as shown in FIG. 4. Each overhead conveyor system includes a conveyor 62A, 62B, 62C or 62D which receives cigarettes from the corresponding chute 60A, B, C or D, either continuously or on a time-sharing basis. As an example of the latter arrangement, which is preferred, the conveyors 62A to D may run successively so that each in turn receives the full output of the making machine 56 for a short predetermined period; part of this flow to each conveyor is fed to the associated packing machine, and the remainder is stored in the associated reservoir for use while that conveyor is not receiving cigarettes from the making machine 56.

Figure 6:
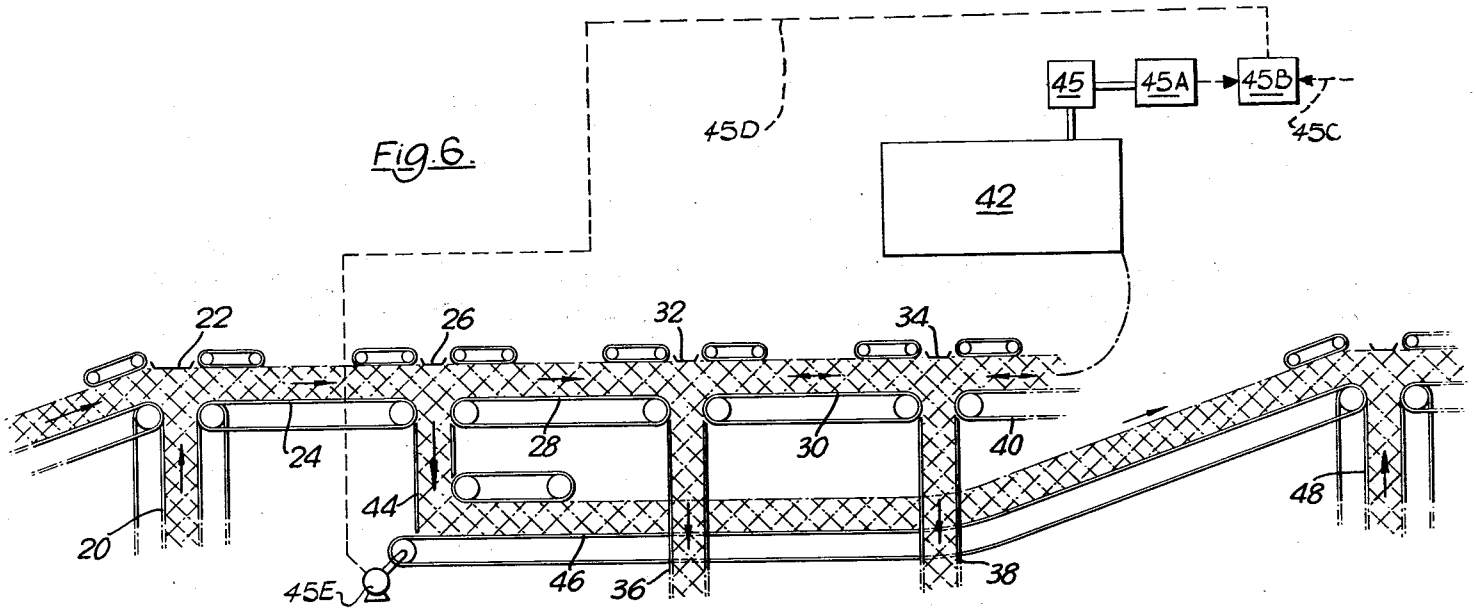
FIG. 6 is a diagrammatic side elevation of part of a "ring main" system.

FIG. 6 shows part of a different system which may be termed a "ring main" system. In this system the transfer conveyor is of composite construction and includes sections which serve also to feed cigarettes directly from making machines to associated packing machines. The system includes a plurality of maker/packer/reservoir units (basically like that shown in FIG. 4) which are joined end-to-end in series to form a closed loop, and may include one or more additional packing or making machines to allow for a slight mis-match within the units.

Each cigarette making machine (not shown) delivers cigarettes upwards through an elevator (e.g. elevator 20 of the unit shown in full in FIG. 6) leading to a junction below a sensor 22. The sensor 22 controls the speed at which cigarettes are carried in stack formation, in the direction shown, by an overhead conveyor 24 leading to a junction below a sensor 26. Cigarettes are carried from that junction by conveyors 28 and 30 to junctions which lie respectively below sensors 32 and 34 and above chutes 36 and 38 leading to two packing machines (not shown). A further conveyor 40 delivers cigarettes to or from a reservoir 42.

Surplus cigarettes not required by the two packing machines are fed down a chute 44 leading to a conveyor 46 forming part of the transfer conveyor. The conveyor 46 is of a laterally flexible construction, for example as described in McCombie U.S. Pat. No. 4,030,595, so as to be able to move along a path which curves around the chutes 36 and 38. Furthermore it will be seen that the conveyor 46 moves upwards so that its downstream end is at the level of the next junction into which the cigarette making machine of the adjacent downstream unit delivers cigarettes through an elevator 48.

The speed and direction of movement of the conveyor 40 is determined basically by the supply and demand conditions at the junction above the chute 38. However, in addition it may be subject to an overriding control depending upon the state of the reservoir (i.e. the quantity of cigarettes in it) as compared with that of the adjacent downstream reservoir. As already explained, such control may be arranged so as to tend to equalise the quantity of cigarettes in the various reservoirs.

The state of each reservoir may be monitored, for example, by a potentiometer device (shown diagrammatically as 45A in FIG. 4) driven by a reduction gear 45, from one of the drums of the reservoir (assuming the reservoir is in the form shown in FIGS. 1 and 2 of British Pat. No. 1,299,174). The reduction gear may be such that the total rotary movement of the potentiometer drive is less than 360° so that the rotation of the potentiometer drive is representative of the quantity of cigarettes in the reservoir. An electrical signal may be obtained by means of the potentiometer, the signal being proportional to the quantity of cigarettes in the reservoir. This signal may be fed to a comparator device 45B which also receives a similar condition-indicating signal via a line 45C from a similar potentiometer device associated with the next reservoir. The comparator device 45B feeds a control signal to a line 45D if the signal from line 45C is smaller than that from potentiometer device 45A; and the control signal switches on means 45E for driving the conveyor 46.

Figure 8:
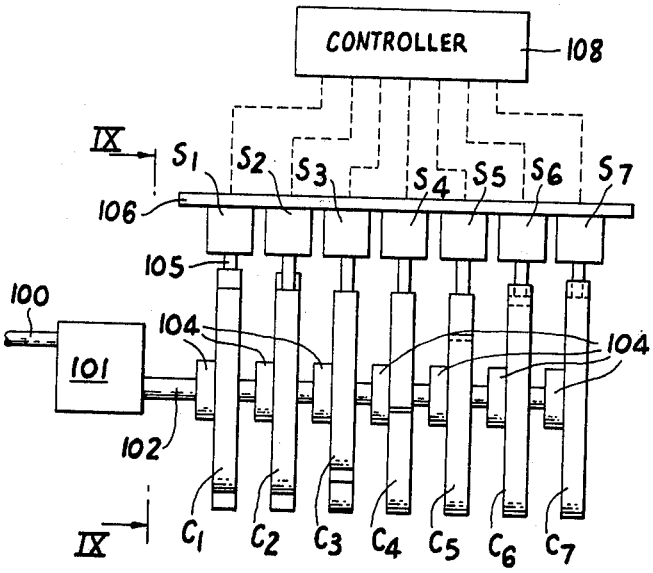
FIG. 8 is a perspective view of a reservoir condition indicating device which may be used in the system shown in FIG. 6 or FIG. 7.
Figure 9:
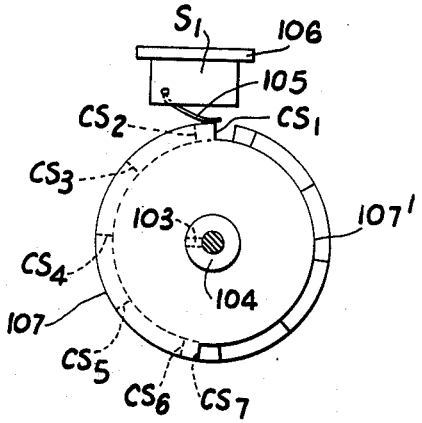
FIG. 9 is a section on line IX—IX in FIG. 8.

In place of the potentiometer it is possible to use the reservoir condition indicator shown in FIGS. 8 and 9. The reservoir is as described in McCombie U.S. Pat. No. 4,030,595. FIG. 8 of the present application shows a flexible drive member 100 whereby a rotary drive is transmitted to a gear box 101 from one of the sprockets (e.g. sprocket 612) around which the chain 324 of the McCombie reservoir conveyor 602 is arranged to pass. Accordingly a reversible rotary drive is transmitted by the member 100 whenever the reservoir conveyor is driven to absorb cigarettes into the reservoir or to deliver cigarettes from the reservoir.

The gear box 101 has an output shaft 102 which rotates far more slowly than the drive member 100 as a result of the step-down ratio of the gearbox. The arrangement is such that slightly under half a revolution of the shaft 102 covers the entire range of operating conditions of the reservoir; i.e. from the "reservoir full" condition to the "reservoir empty" condition.

Seven cams C1 through C7 are secured to the shaft 102 by screws 103 engaging in bosses 104 on the cams. Each cam has an associated microswitch S1, S2, S3 etc. having a pivoted actuator 105 (see FIG. 9) for engaging the associated cam; the microswitches are mounted on a fixed member 106 and are operated by lifting respective actuators 105.

The cams C1 through C7 are all identical. Each has a part-cylindrical surface 107 and a recessed portion 107' separated by a respective step CS1, CS2 etc. However, the cams are mounted at different angular positions about the axis of the shaft 102, as shown by the different positions of their respective steps CS1, CS2 etc. The step CS1 has rotated in a clockwise direction past the switch S1 so as to engage and operate the switch S1. Switch S1 is the only switch that is engaged by the cylindrical surface 107 of the respective cam. This represents the "reservoir empty" condition, which means in practice that the reservoir is very nearly empty; during normal operation when this stage is reached, the associated packing machine is automatically stopped by a controller device 108, so that the reservoir can again begin to fill up. If the cam C1 rotates slightly further in a counter-clockwise direction so that not even switch S1 is engaged, the conveyor forming the floor of the reservoir is immediately stopped.

When the packing machine is stopped as a consequence of only switch S1 being engaged then (assuming that the associated making machine is operating) the reservoir begins to fill up. Movement of the reservoir is transmitted to the cam shaft 102 via the drive 100 and gear box 101. The shaft 102 rotates in a clockwise direction and, after a few degrees of rotation of the shaft 102, the step CS2 of cam C2 reaches and engages the associated switch S2. Engagement of switch S2 causes controller 108 to switch on again the associated packing machine.

When step CS6 of cam C6 engages switch S6, this indicates to the controller that the reservoir is nearly full (which information may be visibly displayed on a control panel); when switch S7 is engaged by step CS7 of cam C7, indicating that the reservoir is completely full, the controller automatically stops the associated maker. The reservoir then begins to empty, and operation of the maker is resumed when switch S7 is again disengaged.

Engagement and operation of switches S3, S4 and S5 by the respective cams indicates respective intermediate conditions of the reservoir. For convenience in the following description, the engagement respectively of switch S2 through S6 will be referred to as being indicative of reservoir conditions 1 through 6.

Each controller 108 is connected to the switches S1–S7 of the associated reservoir and also to the controller of the next adjacent downstream reservoir. If controller 108 for the reservoir in question is registering at a given movement of time that the said reservoir is, for example, in condition 5, and receives an input from the associated controller (for the adjacent downstream reservoir) indicative that said downstream reservoir is in a lower condition (e.g., condition 3 or 4) indicative that said downstream reservoir is less full than the reservoir in question, then controller 108 is programmed to increase the speed of the conveyor 46 (FIG. 6) or of conveyor 88 (FIG. 7), or to cause such conveyor to move if it was not moving, so as to transfer cigarettes from the reservoir in question to the said adjacent downstream reservoir. Such transfer of cigarettes continues until the two reservoirs attain the same condition as registered by their respective controllers.

As a modification of the above arrangement, the controller 108 of the reservoir in question may be programmed to transfer cigarettes to the next adjacent downstream reservoir only if and for as long as the reservoir in question is in a condition two steps higher than the said adjacent reservoir.

Another possible modification is as follows. The controller of the reservoir in question causes cigarettes to be transferred to the next adjacent reservoir only if the reservoir in question is in condition 5 or higher (i.e. is more than half full) and if the said adjacent reservoir is in condition 3 or lower (i.e. is less than half full). The cam C4 and switch S4 may in that case be omitted.

The cams C1, C2 etc. are all individually adjustable as regards their angular positions with respect to the shaft 102. Adjustment is achieved by loosening the screw 103, rotating the cam about the shaft to the desired position, and then retightening the screw.

The following modification is possible. The chute 44 in FIG. 6 is used to deliver cigarettes to a packing machine, and the chute 38 is arranged to deliver cigarettes onto the conveyor 46, which in that case starts below the chute 38.

Figure 7:
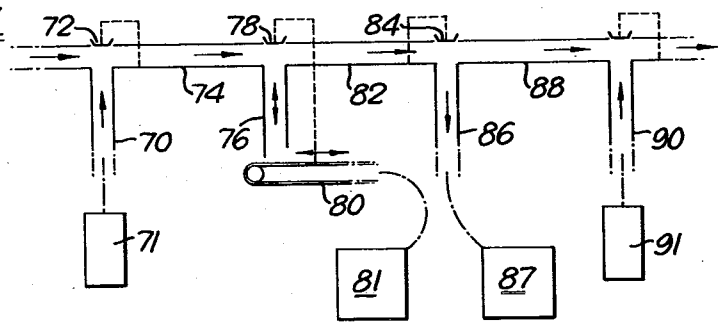
FIG. 7 is a diagrammatic side elevation of part of another "ring main" system.

FIG. 7 shows part of an alternative "ring main" system. As in FIG. 6, one complete cigarette maker/packer/reservoir unit is shown. The unit includes an elevator 70 which delivers cigarettes upwards from a making machine 71 to a junction below a sensor 72. A conveyor 74 delivers cigarettes, in the direction shown, to a junction situated above a vertical feed 76 and below a sensor 78; the vertical feed 76 (which may be as described in the above-mentioned U.S. Pat. No. 4,120,391) delivers cigarettes to or from a reversible conveyor 80 leading to a reservoir shown diagrammatically as 81. A further conveyor 82 delivers cigarettes to a junction situated below a sensor 84 and above a chute 86 leading to a packing machine 87. Surplus cigarettes from this maker/packer unit are fed by a conveyor 88 to a junction above an elevator 90 extending upwards from the adjacent downstream making machine 91. This arrangement is repeated any desired number of times (possibly with the addition of one or more makers or one or more packers) and forms a closed loop or "ring main".

As shown by dotted lines and arrows, the sensors 72 and 84 control the speeds respectively of the conveyors 74 and 82, while the sensor 78 controls the speed and direction of the conveyor 80. The speed of the conveyor 88 is preferably controlled by means of a circuit comparing the state of the reservoir 81 of this unit with the state of the reservoir of the next adjacent downstream unit, so as to tend to equalise the states of the various reservoirs as previously described in relation to FIG. 6.

Figure 10:
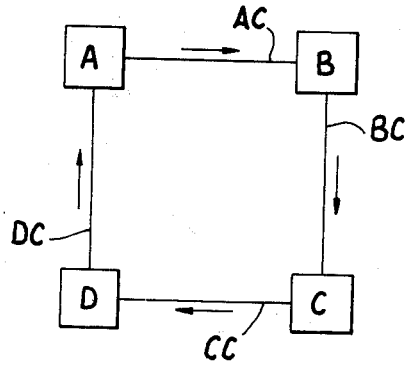
FIG. 10 is a diagrammatic plan view of a "ring main" system.

FIG. 10 is a diagrammatic plan view of a "ring main" system of which the details may be in accordance with FIG. 6 or FIG. 7. The system includes four maker/-packer/reservoir units A, B, C and D linked to form a closed loop or "ring main" by unidirectional conveyors AC, BC, CC, and DC. Each of said conveyors corresponds to conveyor 46 or conveyor 88 of the units shown respectively in FIGS. 6 and 7. As shown in FIG. 10, the transfer of cigarettes between the units occurs in a clockwise direction around the loop or "ring main".

We claim:

1. A cigarette making system comprising a number of units each including at least one cigarette making machine, at least one cigarette packing machine, and at least one cigarette reservoir interconnected so that a continuous multi-layer stack of cigarettes is supplied from said making machine to said packing machine and/or said reservoir and from said reservoir to said packing machine within each unit; and conveyor means including transfer conveyor sections which link all of said units in a closed loop path for conveyance of cigarettes as a continuous multi-layer stack between a cigarette making machine or reservoir in one unit and a cigarette packing machine or reservoir in another unit to control the quantity of cigarettes available in each unit.

2. A system according to claim 1 in which there are a number of reservoirs at spaced positions along the closed loop path formed by said conveyor means, each reservoir having a condition-indicating device indicating the quantity of cigarettes in the reservoir, and including means for controlling the transfer conveyor sections which extend between the reservoirs as to their speed so as to tend to equalize the quantity of cigarettes available to the respective packing machines in each unit in response to signals from the condition-indicating devices.

3. A system according to claim 2 which is arranged to convey surplus cigarettes in a predetermined direction along the transfer conveyor, including means for controling the transfer conveyor section between each unit and the next downstream unit in response to a comparison between signals obtained from the condition-indicating devices of the reservoirs in the respective units.

4. A system according to claim 1 in which the or each reservoir is connected to a transfer conveyor section by a vertical reversible feed.

5. A method of making and packing cigarettes, comprising forming machine units each including a making machine and a packing machine and a reservoir: feeding cigarettes directly from the making machine in each unit to the associated packing machine; controlling the reservoir of each unit to absorb or discharge cigarettes basically in accordance with the difference between the rates of supply and demand within the unit; conveying excess cigarettes from each unit directly to an adjacent unit; monitoring the condition of each reservoir; and adjusting the conveyance speeds of cigarettes between units so as to tend to equalise the quantity of cigarettes in the various reservoirs; the various units all being connected together by conveyors forming a closed loop, the flow of excess cigarettes between adjacent units being in one predetermined direction.

6. Apparatus for making and packing cigarettes, comprising a plurality of assemblies each comprising a cigarette making machine, a packing machine linked to the making machine by a continuous conveying means, and a cigarette reservoir coupled to the continuous conveying means to accommodate short-term differences between the rate of manufacture of cigarettes by the making machine and the rate of consumption by the packing machine; and including transfer conveyor means forming a closed loop path for transferring excess cigarettes from one assembly to another whereby an excess of cigarettes from one assembly may be absorbed by the other assembly.

7. A cigarette making system comprising a plurality of units, each including at least one cigarette making machine, at least one cigarette packing machine, and machine linking conveyor means for conveying a multi-layer continuous stream of cigarettes from said making machine to said packing machine; and, unit linking conveyor means for linking said units in a closed loop to effect transfer of cigarettes in a multi-layer continuous stream from unit to unit to control the quantity of cigarettes available for packing in each unit.

8. A cigarette making system according to claim 7, wherein each unit further includes reservoir means for storage of cigarettes coupled to said machine linking conveyor means.

9. A cigarette making system according to claim 8, wherein said reservoir means is coupled to said machine linking conveyor means in each unit by way of a chute.

10. A cigarette making system according to claim 8, wherein said reservoir means is directly coupled to said machine linking conveyor means in each unit.

11. A cigarette making system according to claim 7, wherein said unit linking conveyor means comprises a plurality of conveyor sections each extending between a respective pair of units and forming a continuation of the machine linking conveyor means therein.

12. A cigarette making system according to claim 7, wherein said unit linking conveyor means comprises a plurality of individual conveyor sections extending between the respective units and being coupled to the machine linking conveyor means therein.

13. A cigarette making system according to claim 7, wherein at least one of said units includes reservoir means directly coupled to said machine linking conveyor means for storing cigarettes in a continuous multi-layer stream.

* * * * *